US011313113B1

(12) United States Patent
Nashed

(10) Patent No.: US 11,313,113 B1
(45) Date of Patent: Apr. 26, 2022

(54) PIPE CONNECTOR APPARATUS

(71) Applicant: Sedation Systems, LLC, St. Petersburg, FL (US)

(72) Inventor: Ramses S. Nashed, Tierra Verde, FL (US)

(73) Assignee: Sedation Systems, LLC, St. Petersburg, FL (US)

( * ) Notice: Subject to any disclaimer, the term of this patent is extended or adjusted under 35 U.S.C. 154(b) by 0 days.

(21) Appl. No.: 17/248,138

(22) Filed: Jan. 11, 2021

Related U.S. Application Data

(60) Provisional application No. 62/995,133, filed on Jan. 14, 2020.

(51) Int. Cl.
*E03C 1/288* (2006.01)
*E03C 1/14* (2006.01)

(52) U.S. Cl.
CPC ..... *E03C 1/288* (2013.01); *E03C 1/14* (2013.01)

(58) Field of Classification Search
CPC ..... E03C 1/288
USPC ..... 4/679, 378, 584, 613, 650, 668, 671; 285/134.1; 137/247.41, 362, 577
See application file for complete search history.

(56) References Cited

U.S. PATENT DOCUMENTS 2,302,617 A * 11/1942 Little ..... F16L 19/0225 285/334.1
3,396,752 A * 8/1968 Strout ..... E03C 1/292 138/27
3,719,209 A * 3/1973 Rush ..... B29C 49/4278 138/177
3,994,031 A * 11/1976 Bishop ..... E03C 1/284 4/679
4,218,786 A * 8/1980 Taglarino ..... E03C 1/24 137/247.25
4,230,582 A * 10/1980 Tuleja ..... B01D 35/02 137/247.51
5,039,135 A * 8/1991 Palmer ..... E03C 1/28 285/179
5,413,705 A * 5/1995 Tammera ..... B01D 21/265 210/163
5,944,985 A * 8/1999 Bowman ..... B01D 61/10 210/153
5,946,747 A * 9/1999 Geeham ..... E03D 1/145 4/684
6,318,397 B1 * 11/2001 Huber ..... E03F 5/0407 137/15.19
6,341,390 B1 * 1/2002 Lovelace ..... E03C 1/122 4/679
6,425,411 B1 * 7/2002 Gorges ..... E03C 1/28 137/247.39
6,651,272 B2 * 11/2003 Bowman ..... B01D 61/10 285/132.1

(Continued)

*Primary Examiner* — Lori L Baker
(74) *Attorney, Agent, or Firm* — Nicholas Pfeifer; Smith & Hopen, P.A.

(57) ABSTRACT

A connector apparatus featuring a main pipe with first and second opposed ends. Each has a corresponding male-threaded fastening section for mating with the complimentary female-threaded fastening section on a respective conventional pipe-locking ring or collar. A valve-housing for supporting a one-way flow valve assembly interiorly, and a riser mounted on and supported by the valve housing for ultimate connection to the output or exhaust nozzle of a medical scavenger device.

20 Claims, 12 Drawing Sheets

(56) References Cited

U.S. PATENT DOCUMENTS 6,701,965 B1 * 3/2004 Grace ..... E03C 1/12 138/112
6,845,527 B1 * 1/2005 Kohn ..... E03C 1/12 137/247.41
6,959,723 B2 * 11/2005 Gorges ..... E03C 1/28 137/247.39
7,531,088 B2 * 5/2009 Gurmu ..... E03C 1/282 137/247.51
7,799,216 B2 * 9/2010 Gurmu ..... E03C 1/282 210/153
10,086,166 B1 * 10/2018 Nashed ..... A61M 16/104
10,722,674 B2 * 7/2020 Nashed ..... A61M 16/085
2002/0189675 A1 * 12/2002 Huber ..... E03F 5/08 137/362
2004/0049846 A1 * 3/2004 Cornwall ..... E03F 5/042 4/679
2005/0268396 A1 * 12/2005 Wilburn ..... E03C 1/284 4/679
2006/0265804 A1 * 11/2006 Santa Ana ..... E03C 1/284 4/679
2007/0011808 A1 * 1/2007 Park ..... E03C 1/284 4/679
2008/0148477 A1 * 6/2008 Shafik ..... E03C 1/284 4/679
2011/0145989 A1 * 6/2011 Jan ..... E03C 1/282 4/679
2012/0192349 A1 * 8/2012 Torres ..... E03B 1/042 4/555
2014/0331404 A1 * 11/2014 Sumner ..... E03C 1/28 4/679
2014/0352047 A1 * 12/2014 Goldsmith ..... E03C 1/288 4/301
2014/0373943 A1 * 12/2014 Huber ..... F16K 15/031 137/362
2015/0013058 A1 * 1/2015 Bucher ..... E03D 9/037 4/378
2016/0002903 A1 * 1/2016 Grover ..... E03D 1/145 4/405
2018/0180205 A1 * 6/2018 Olson ..... F16L 27/12
2019/0153717 A1 * 5/2019 Jarrar ..... E03C 1/288
2020/0370690 A1 * 11/2020 McAlpine ..... E03C 1/182

* cited by examiner

PIPE CONNECTOR APPARATUS

CROSS-REFERENCE TO RELATED APPLICATIONS

This nonprovisional application is a continuation of and claims priority to provisional application No. 62/995,133, entitled "PIPE CONNECTOR APPARATUS," filed Jan. 14, 2020 by the same inventor.

BACKGROUND OF THE INVENTION

1. Field of the Invention

This invention relates, generally, to pipe connector assemblies. More specifically, it relates to a pipe connector apparatus or assembly for connecting the exhaust line of a medical gas scavenging device to a drainpipe in a building or other structure for discharge into the building's wastewater collection system.

2. Brief Description of the Prior Art

It is frequently necessary to vent the exhaust gas emanating from a medical device, such as a gas analgesia machine, outside of the immediate location or treatment room where the medical device is being used. This is currently accomplished by placing a pipe vent in a wall of the treatment room to exhaust the waste gas outside the corresponding building structure. However, when the medical device producing the waste gas is located in an interior room, with no exterior building walls, such a solution becomes impracticable.

To overcome this problem, it is necessary to employ an efficient venting system to remove medical waste gas from interior rooms. Such a venting system includes a connection between the exhaust hose of a medical gas scavenging device to a plumbing fixture drainpipe within a room, such as a sink or washbasin as is common in medical office or building.

Accordingly, what is needed is an in-line pipe connector apparatus capable of discharging an exhalation gas safely and effectively from a treatment room. What is also needed is an in-line pipe connector apparatus that is adaptable to be installed under a conventional washbasin downstream from the trap. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act, or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an in-line pipe connector assembly capable of being installed onto existing drainpipes for safely discharging an exhalation gas of a patient undergoing treatment is now met by a new, useful, and nonobvious invention.

The novel system for exhausting a waste gas, such as a medical waste gas, from the interior environment of a building comprises a plumbing trap having a first trap end and a second trap end. The first trap end is configured to be in mechanical communication with a washbasin located within the interior environment, such as a medical treatment room. The pipe connector assembly includes a main pipe member that extends between a first member end and a second member end. The first member end is in mechanical communication with the second trap end. A valve housing includes a proximal end, a distal end, and a valve to control the flow of the medical waste gas. The valve, such as a one-way valve, resides within the valve housing and is disposed between the proximal end and the distal end of the valve housing. The proximal end of the valve housing is in mechanical communication with the main pipe member, and the distal end is in mechanical communication with a gas scavenger device. Furthermore, a drainpipe has a first end in mechanical communication with the second member end of the pipe connector assembly and a second end in mechanical communication with a building's waste collection system. The waste gas flows from the gas scavenger device through the pipe connector assembly and is ultimately discharged into the waste collection system of the building, such that the waste gas is safely removed from the internal environment.

In an embodiment, a quick release valve having an inlet, an output, and a passage extending between the inlet and the output is provided. The inlet is configured to be removably coupled to an exhaust hose of the gas scavenger device, and the output is in mechanical communication with the distal end of the valve housing.

In yet another embodiment, a riser is disposed between the valve housing's distal end and the gas scavenger device. The riser includes a body defining a bore extending between a first riser end coupled to the distal end of the valve housing and a second riser end coupled to an exhaust hose of the gas scavenger device. The riser being in fluid communication with the main pipe member and the gas scavenger device.

In an embodiment, a first attachment mechanism is disposed at the first member end and configured to threadedly engage with a second attachment mechanism disposed at the second trap end of the plumbing trap. Furthermore, a third attachment mechanism is disposed at the second member end and configured to threadedly engage with the first end of the drainpipe. In such embodiments, the pipe connector assembly is secured between the plumbing trap and the drainpipe.

The valve includes a flexible portion configured to be translatable between a closed configured and an open configuration in an embodiment. In particular, the flexible portion is biased toward the closed position, such that the backflow of the waste gas from the waste collection system back into the internal environment is prevented. Furthermore, in the open configuration, the flexible position permits the waste gas to flow through the valve housing from the internal environment to the building's waste collection system.

In an embodiment, the structure includes an in-line pipe connector assembly for discharging a gas, such as a medical or waste gas, from a treatment room. The in-line pipe connector assembly includes a main pipe member. The main pipe member has a body defining a bore extending between a first peripheral end edge and a second peripheral end edge. The first peripheral end edge defines a first end opening, and the second peripheral end defining a second end opening. A first fastening section is disposed at the first peripheral end edge, and a second fastening section is disposed at the second peripheral end edge. Furthermore, a through-hole is disposed within the body and extends between an exterior surface and an interior surface of the main pipe member.

A riser is in fluid communication with the main pipe member. The riser includes a bore extending between a first riser end and a second riser end.

A support boss is in mechanical communication with the main pipe member and the riser. The support boss includes a body extending between a first boss end defining a first boss opening and a second boss end defining a second boss opening. The first boss end extends at least partially through the through-hole at least partially within the main pipe member's bore. A first boss recess is formed within the first boss end and is in fluid communication with the second boss recess formed within the second boss end. Additionally, a support ledge is formed within an exterior surface of the first boss end.

A valve housing includes a top peripheral end edge disposed at a top valve housing portion, and a bottom peripheral end edge is disposed at a bottom valve housing portion. The bottom peripheral end edge is configured to abut the support ledge of the support boss. A valve recess extends from the top peripheral end edge to a riser support floor member, wherein the valve recess is configured to receive the first riser end, such that the first riser end abuts the riser support flow member.

Moreover, the riser support flow member includes a central hub defining a central valve-step support aperture and a rib extending radially between the central hub and the top valve housing portion. A chamber extends between the riser support floor member and the first boss recess. The chamber is in fluid communication with the first boss recess and the bore of the riser.

A valve-assembly disposed within the valve-housing and includes a support spindle including a first end and a second opposite end. The first end is disposed at least partially within the central valve-step support aperture. A nub is disposed on a portion of the support and prevents the support spindle from being removed from within the central valve-step support aperture. A flexible portion is disposed at the second end of the support spindle. The flexible portion includes an open configuration and a closed configuration. When in the open configuration, the valve-housing is configured to permit the flow of a fluid, such as an exhalation gas from a patient, to flow through the main pipe member. In the closed configuration, the fluid flow through the chamber between the riser and the main pipe member is prevented. The flexible member is biased toward the closed configuration.

In an embodiment, the in-line pipe connector assembly further comprises a quick release valve having an inlet, and output, and a passage that extends between the inlet and the output. The inlet is configured to be coupled to an exhaust hose of the gas scavenger device, and the output is configured to be coupled to the second riser end. Accordingly, the patient's exhalation gas travels from the gas scavenger device through the quick-release valve to the in-line pipe connector assembly, where the exhalation gas is exhausted into a water (or waste) collection system of the building.

A novel method for the removal (or evacuation) of a medical gas from a treatment room of a building is detailed where a connection apparatus is provided. The method then proceeds in which a second trap end of a plumbing trap is coupled to a first member end of a pipe connector. The plumbing trap having a first trap end opposite a second trap end, wherein the first trap end is coupled to a washbasin. Next, a second member end of the pipe connector is coupled to a drainpipe. The drainpipe being in fluid communication with a waste collection system of the building. An exhaust hose in fluid communication with a medical gas scavenging device is coupled to a valve housing's distal end. Next, an amount of the medical waste gas emitted by the medical gas is transferred, via the exhaust hose, to the pipe connector. Lastly, the amount of the medical gas is exhausted, via the drainpipe, into the building's waste collection system.

These and other important objects, advantages, and features of the invention will become clear as this disclosure proceeds.

The invention accordingly comprises the features of construction, combination of elements, and arrangement of parts that will be exemplified in the disclosure set forth hereinafter, and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
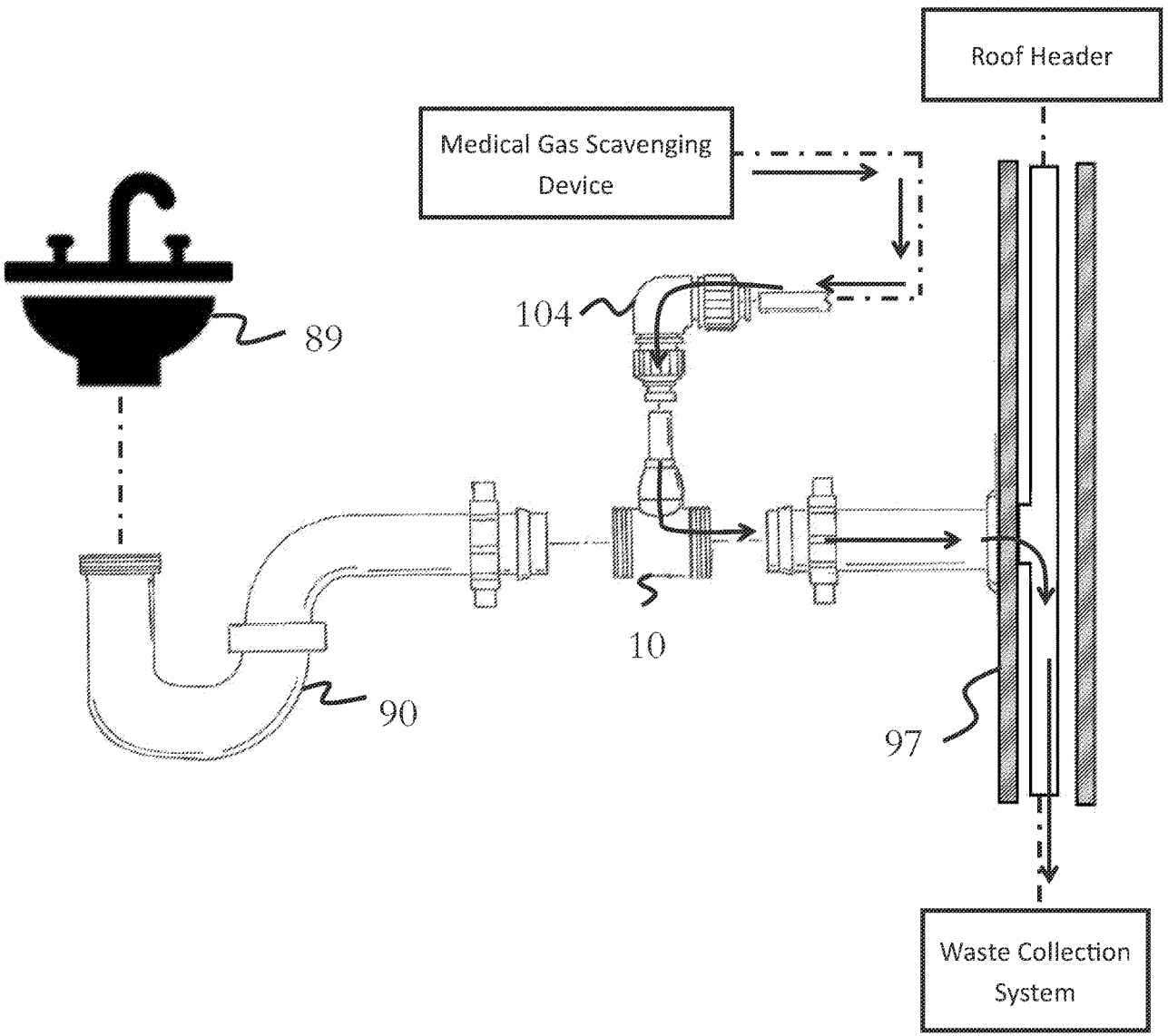
FIG. 1 is a schematic view of an embodiment of the pipe connector apparatus of the present invention in fluid communication with an analgesia system.
Figure 2:
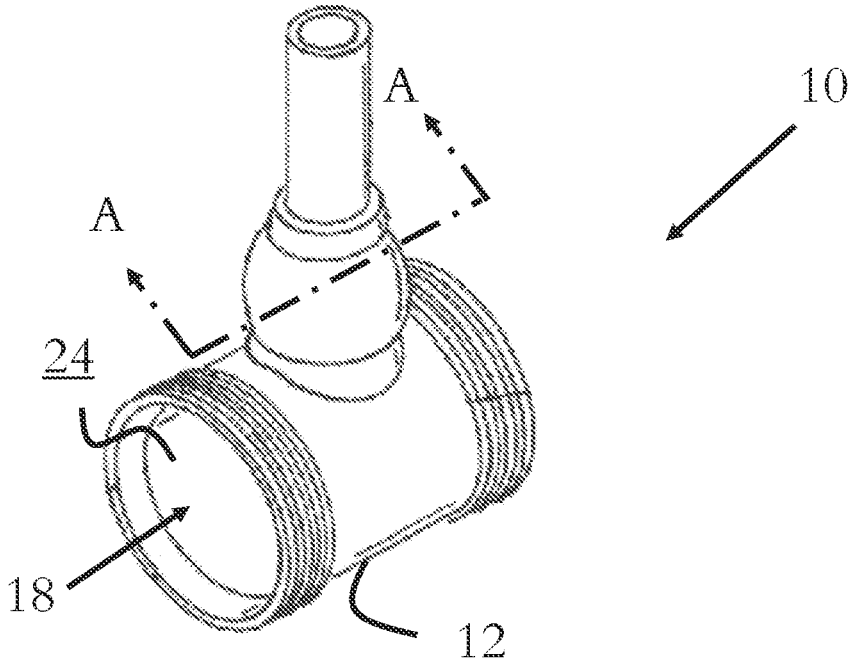
FIG. 2 is a perspective view of an embodiment of the connector apparatus of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a simple, compact, and inexpensive connector assembly which easily may be installed in a drainpipe of a washbasin without impairing the operation of the plumbing trap, such as a P-trap, within the corresponding washbasin. The unitary in-line pipe connector assembly includes a main pipe member having first and second opposed ends. Each end includes a corresponding male-threaded fastening section for mating with a complementary female-threaded fastening section on a respective conventional pipe-locking ring or collar. In addition, each end includes a valve-housing for supporting an interior one-way flow valve assembly, as well as a riser mounted on and supported by the valve housing for ultimate connection to the output or exhaust nozzle of a medical scavenger or evacuation device.

In use, a section of the drainpipe proximal to output side of the plumbing trap is removed, and the connector apparatus of the invention is lockingly sealed into place in the drainpipe in place of the removed section. The scavenger exhaust nozzle is then connected to the riser on the connector apparatus valve housing. Exhaust gas from the scavenger flows through the one-way valve into the building waste drainage system. The in-line pipe connector assembly prevents the back-flowing of the gas from the waste system by the blocking action of the one-way valve.

Turning initially to FIGS. 1-10, unitary in-line pipe connector assembly 10 (hereinafter "pipe connector assembly 10") comprises three primary components: main pipe member 12, valve housing 14, and riser 16 extending upwardly away from valve housing portion 14.

Main Pipe Member

Main pipe member 12 is cylindrically shaped, defining a hollow bore or central passage 18 extending between first peripheral end edge 20 and second peripheral edge 22, such that central passage 18 is formed throughout main pipe member 12. As such, first peripheral end edge 20 defines first opening 21, and second peripheral end edge 22 defines second opening 23, such that central passage 18 is formed throughout main pipe member 12.

Figure 3:
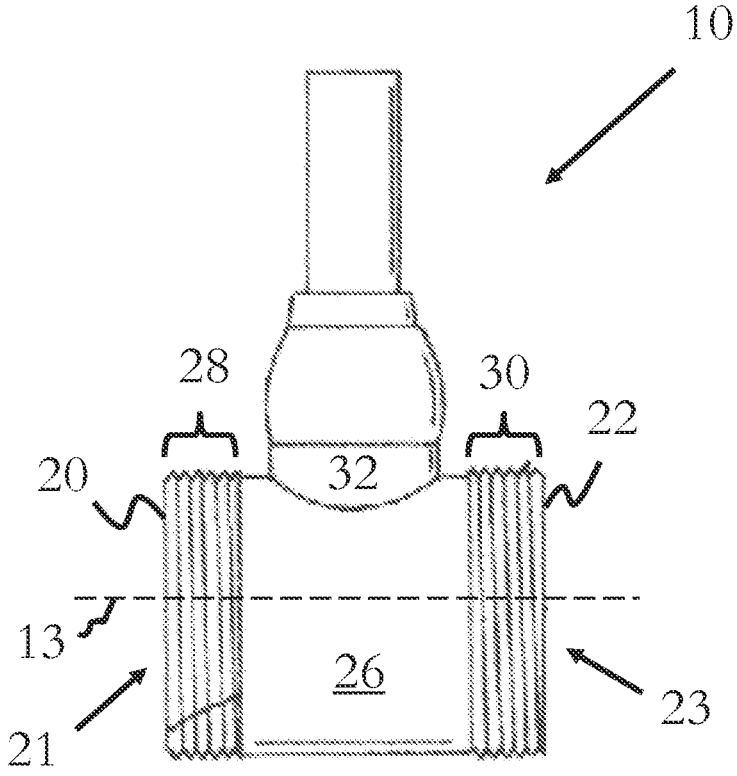
FIG. 3 is a side view of an embodiment of the pipe connector apparatus of FIG. 2.
Figure 4:
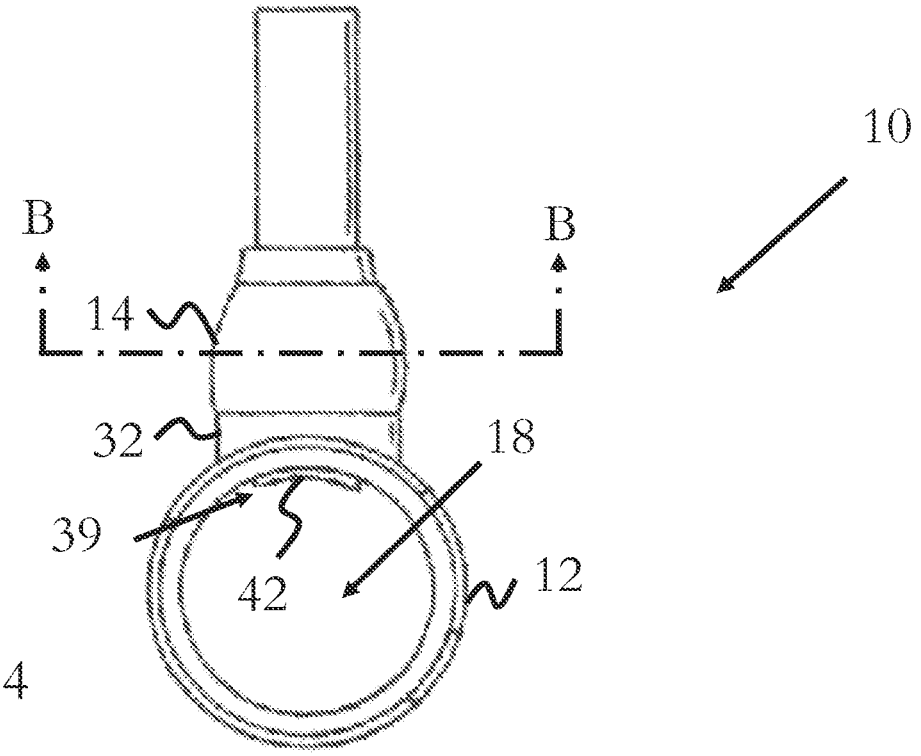
FIG. 4 is a side view of an embodiment of the pipe connector apparatus of FIG. 2.
Figure 5:
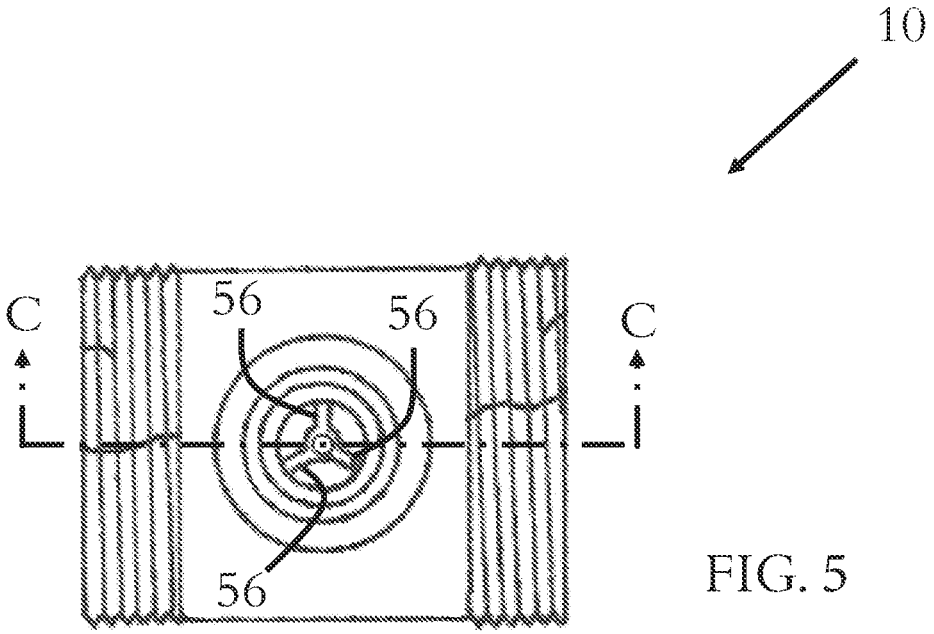
FIG. 5 is a top plan view of an embodiment of the pipe connector apparatus of FIG. 2.

Additionally, main pipe member 12 includes continuous interior wall surface 24 that may be substantially cylindrical and smooth, such that interior wall surface 24 is free from projections or unevenness. In contrast, exterior surface 26 of main pipe member 12 includes first and second spiral fastening sections 28, 30, which may be male-threaded fastening sections, as shown in FIG. 3. As will be described in greater detail below, first and second spiral male-threaded fastening sections 28, 30 mechanically couple with a corresponding complementary spiral female-threaded sections of conventional drainpipe locking rings or collars. In an embodiment, fastening sections 28, 30 may be any fastening means, such that main pipe member 12 is mechanically coupled with a corresponding complementary fastening section of conventional drainpipe locking rings or collars.

Referring to FIGS. 2-9, main pipe member 12 includes valve-housing mounting base 32 (alternatively referred to as "support boss 32") extending orthogonally with respect to central longitudinal axis 13 of main pipe member 12. In an embodiment, support boss 32 is monolithically formed with main pipe member 12. In yet another embodiment, support boss 32 is formed of a separate piece, such that support boss 32 is coupled with main pipe member 12 during the installation or assembly of pipe connector assembly 10 (e.g., such as when pipe connector assembly 10 is installed with an existing waste-collection system of a building).

Support boss 32 includes support boss body 33 extending from first boss end 35 to second boss end 39. Formed within a portion of support boss body 33, peripheral support end edge 34 resides between first boss end 35 and second boss end 39. Peripheral support edge 34 is configured to receive lower portion 47 of valve housing 14, which will be discussed in greater detail below.

Additionally, support boss 32 includes passageway 37 in fluid communication with central passage 18 of main pipe member 12. Passageway 37 includes first passage 38 and second passage 40. First passage 38 is defined by first interior wall 39, and second passage 40 is defined by second interior wall 41. First interior wall 39 has a greater width (or diameter) than second interior wall 41. In an embodiment, first interior wall 39 has a width (or diameter) equal to or less than second interior wall 41.

In an embodiment, annular abutment 42 of second boss end 39 extends at least partially within central passage 18 of main pipe member 12. The partial protrusion of annular abutment 42 into central passage 18 serves as an axial stop member to limit the insertion of end edges 96, 98 (see FIG. 10) longitudinally into central passage 18 when installed with the waste system of the building. In other words, annular abutment 42 prevents one or both of end edges 96, 98 from being disposed within central passage 18 in such a manner that the flow of the fluid from riser 16 to central-passage 18 is restricted or prevented entirely. In an embodiment, the fluid is a medical waste gas, an exhalation gas, waste gas, sewer gas, or any other undesired gas or liquid that a user wishes to exhaust from an environment with the user. In such an embodiment, the environment may be a medical treatment room, storage room, laboratory, or any other confined space that a user seeks to exhaust the fluid from.

Riser

Figure 6:
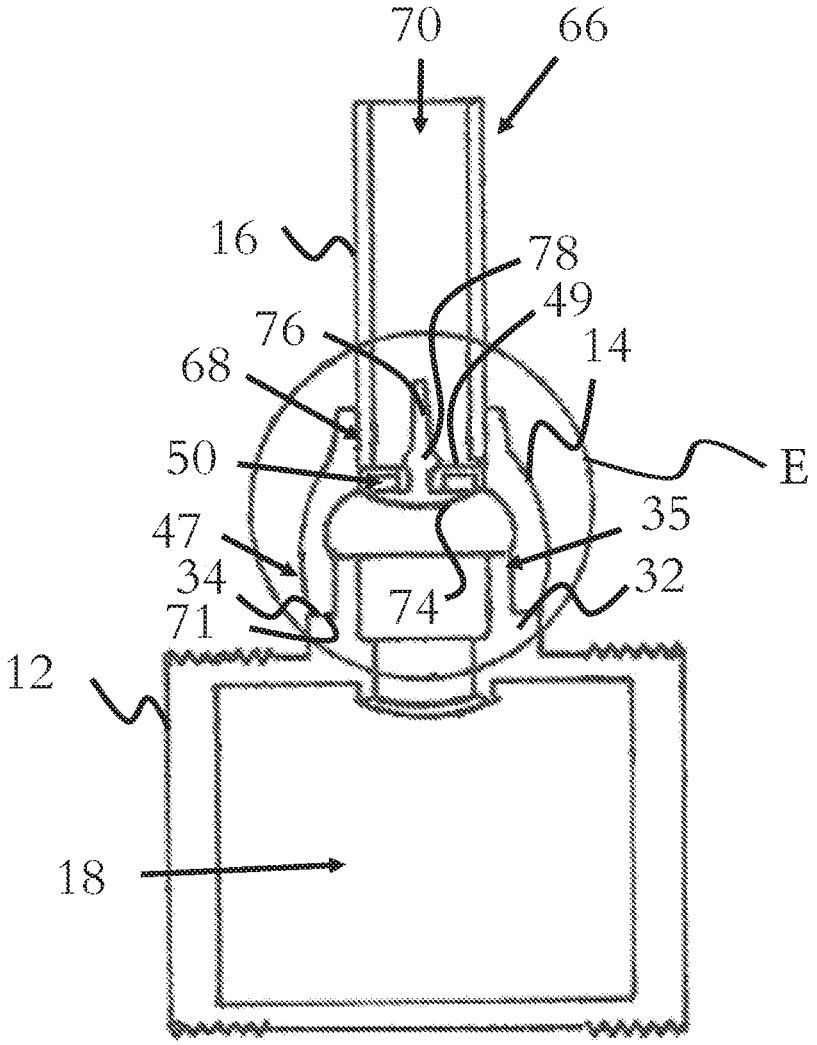
FIG. 6 is a cross-sectional view of an embodiment of the pipe connector apparatus of FIG. 5 taken along line C-C.
Figure 7:
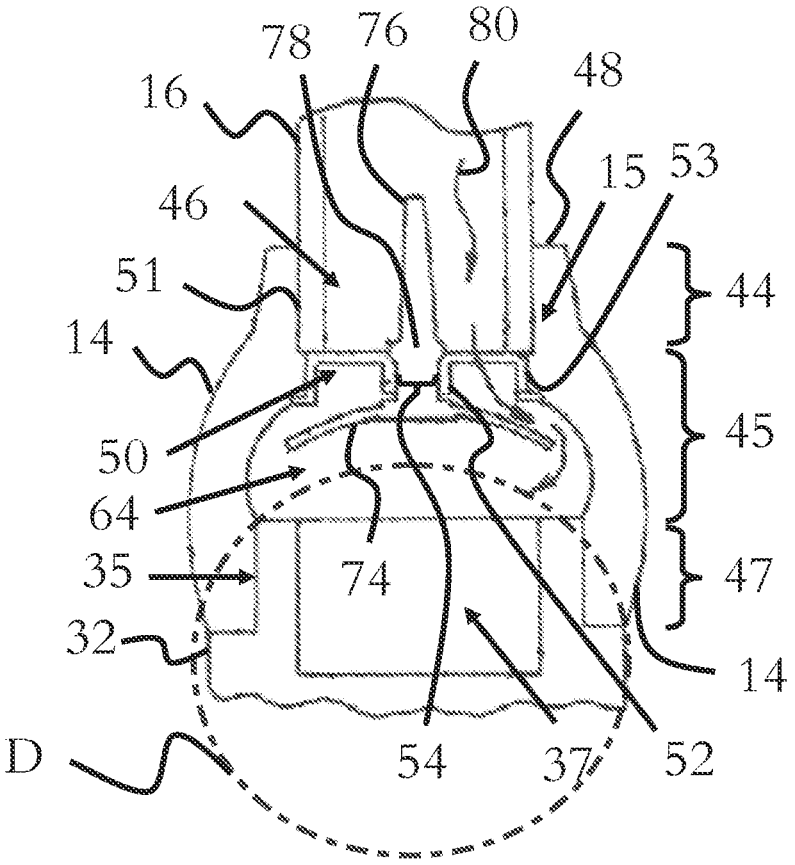
FIG. 7 is a cross-sectional view of Detail E of FIG. 6.
Figure 8:
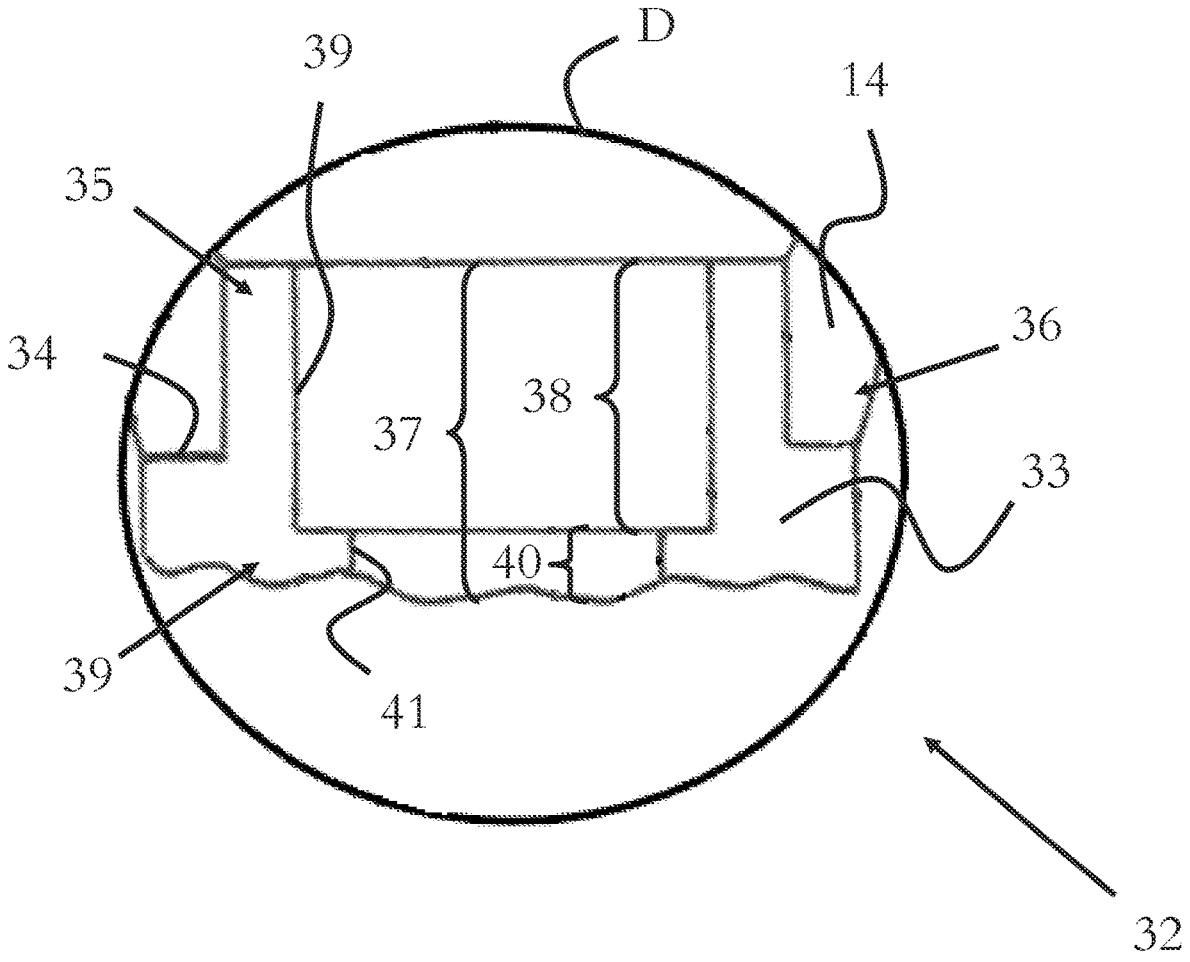
FIG. 8 is an enlarged view of the pipe connector apparatus of FIG. 7, particularly showing the circled portion D, depicting the valve in an open configuration.
Figure 9:
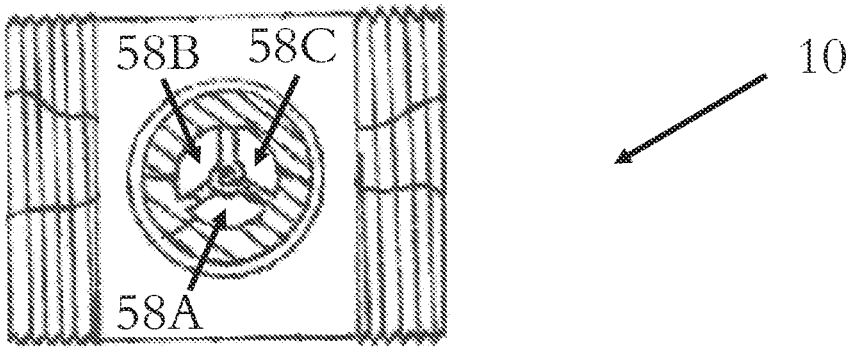
FIG. 9 is a top cross-sectional view of an embodiment of the pipe connector apparatus taken along line B-B of FIG. 4.

As depicted in FIGS. 6 and 7, riser 16 is preferably comprised of a hollow tubular structure having top-end edge 66 and opposed bottom end edge 68 defining central passage 70 extending therethrough. Bottom end edge 68 is configured to be disposed adjacent to top outer circumferential surface 49 of riser-support flow member 50 of valve-housing 14. Furthermore, top-end edge 66 of riser 16 is in mechanical communication with the environment of the building where the fluid is being exhausted (or removed) from. In an embodiment, top-end edge 66 is mechanically coupled to a medical gas scavenging device's exhaust nozzle. In such embodiments, the medical gas scavenging device facilitates the flow of the fluid from the environment, through pipe connector assembly 10, and ultimately into the building's waste-collection system.

Valve Housing

Referring now to FIGS. 6-9, valve-housing 14 controls the fluid flow between riser 16 and passageway 37 via valve-assembly 72 disposed within cavity 64. Specifically, valve-housing 14 prevents the fluid's backflow through pipe connector assembly 10, through riser 16, and ultimately back into the environment with the user.

Valve-housing 14 includes upper portion 44, central portion 45, and lower portion 47. Upper portion 44 of valve-housing 14 is preferably tapered and terminates distally, forming receipt 46 for receiving bottom portion 15 of riser 16. Receipt 46 is defined by first internal wall 51 extending from top peripheral end edge 48 of tapered valve-housing upper portion 44 downwardly to riser-support floor member-generally denoted as reference numeral 50. Riser floor member 50 abuts a portion of second internal wall 53 of central portion 45 of valve-housing portion 14, thereby forming cavity 64 extending between riser floor member 50 and first boss end 35 of support boss 32. Furthermore, riser floor member 50 includes central hub 52 defining central valve-step support opening 54. At least one rib 56 extends radially between hub 52 and upper portion 44 of valve-housing forming passage 58. In an embodiment, three equidistantly spaced-apart ribs 56 extend radially between hub 52 and upper portion 44 of valve-housing 14, thereby forming passages 58A, 58B, and 58C (collectively referred to as passages 58). Lower portion 47 of valve-housing 14 is slidably disposed over and positioned adjacent to first boss end 35. In such configurations, peripheral support edge 34 abuts terminal edge 71 support boss 32.

As noted above, valve assembly 72 regulates the fluid flow between riser 16 and central passage 18 of main pipe member 12. The regulation of the fluid flow may be achieved by transitioning flexible (or umbrella) portion 74 between a closed position (see FIG. 6) and an open position (see FIG. 7). In particular, flexible portion 74 is integrally mounted on supporting spindle 76. Fastening enlargement or nub 78 is provided on spindle 76 and is spaced apart from flexible portion 74. Nub 78 is sized to enable spindle 76 to be press-fit into and through central support opening 54 in floor member 50. By doing so, valve assembly 72 is locked in place and supported by floor member 50 in an operational position (e.g., open or closed position), as shown in FIGS. 6 and 7.

In an embodiment, valve assembly 72 is biased toward the closed position, such that flexible portion 74 is concave (see FIG. 6). Accordingly, when valve assembly 72 is in the closed position, the concave nature of flexible portion 74 completely seals off passages 58 from being in fluid communication with cavity 64. Thus, the backflow of any fluid back into riser 16 is prevented.

Alternatively, when flexible portion 74 is acted upon by the force of a fluid (such as flowing gas from a medical gas scavenging device) traveling through central passage 70 of riser 16, flexible portion 74 flexes and assumes the open configuration having a convex shape (see FIG. 7). In such open configurations, any gas or other fluid flowing through riser 16 will continue to flow as indicated by arrows 80 through passages 58. The fluid then flows into cavity 64 and through passageway 37. Lastly, the fluid exits into central passage 18 of main pipe member 12, where the fluid can be safely discharged into the building's waste-collection system.

Thus, by providing valve-assembly 72 in accordance with the present invention, the pipe connector apparatus 10 of FIG. 2-9 is capable only of uni-directional exhaust flow. Accordingly, any backflow of an undesirable fluid (e.g., sewer gas) into the treatment room or area that may emanate from the building's waste-collection system to which pipe connector assembly 10 is connected is eliminated by the present invention.

Figure 10:
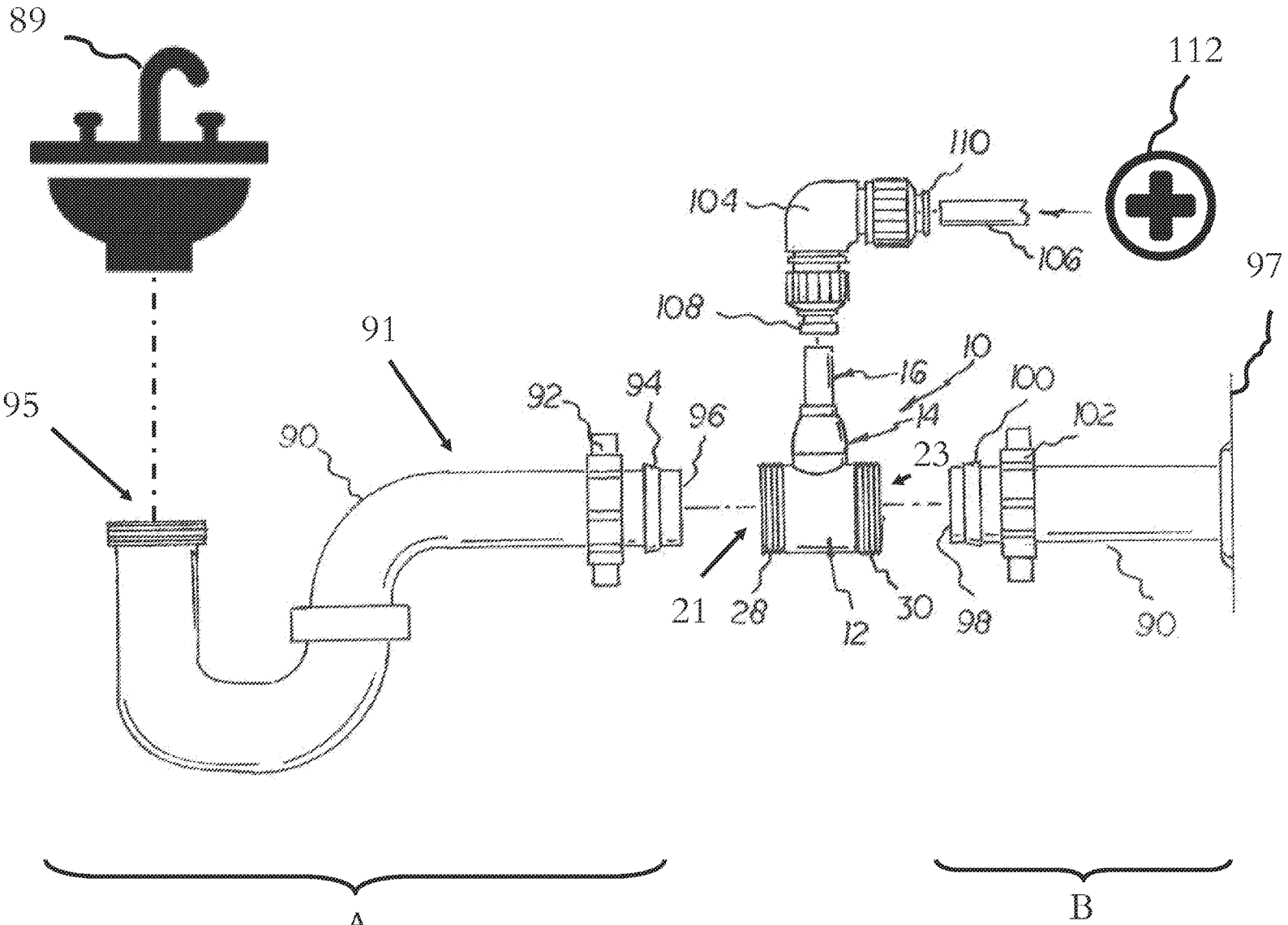
FIG. 10 is an exploded assembly view of an embodiment of the connector apparatus of the present invention in association with a conventional trap and drainpipe set up.

Turning now to FIG. 10, an exploded view of an in-use embodiment is shown. Specifically, drainpipe 90, such as a plumber trap commonly employed underneath a sink or washbasin 89, mechanically couples to pipe connector assembly 10 via straight section 91 that is disposed between output 95 and adjacent wall 97. In particular, connector 10 is installed in the position between longitudinally separated sections A, B of drainpipe 90; for example, a narrow portion of drainpipe 90 can be removed, thereby leaving exposed end edges 96 and 98, respectively. Next, drainpipe locking rings 92 and 102, and their respective retainer rings 94 and 100, are placed on the separated drainpipe sections A, B. From there, cut end edges 96, 98 are inserted into their corresponding first pipe opening 21 and section pipe opening 23 of main pipe member 12. Once inserted into central passage 18, locking rings 92, 102 are rotated to mechanically engage male-threaded sections 28, 30 in a tightened, sealed arrangement.

Additionally, quick-release elbow connector 104 having opposed inlet 110 and output 108 ends is coupled to exhaust hose 106 of medical gas scavenger device 112. Elbow output 108 is then releasably coupled to riser 16. Thus, any gas, or a mixture of gas, being exhausted through hose 106 by gas scavenger device 112 (as indicated by the arrow) flows through connector 10, into central passage 18, and out through second pipe opening 23 of main pipe member 12, into exhaust riser 114 located behind wall 97 (see FIG. 1), and ultimately into the waste-collecting system of the building structure.

Since the gas flowing through connector 10 nominally will be at atmospheric pressure, there is no tendency of the gas to disturb, or remove, or otherwise affect in any way the water column in drainpipe 90. Specifically, the water column prevents any gas from the building's waste collection system from back-flowing through the sink drain into the room where the sink is located. And, by the same token, in accordance with the present invention, one-way valve assembly 72 in connector 10 prevents the backflow of any such gas through riser 16.

Figure 11:
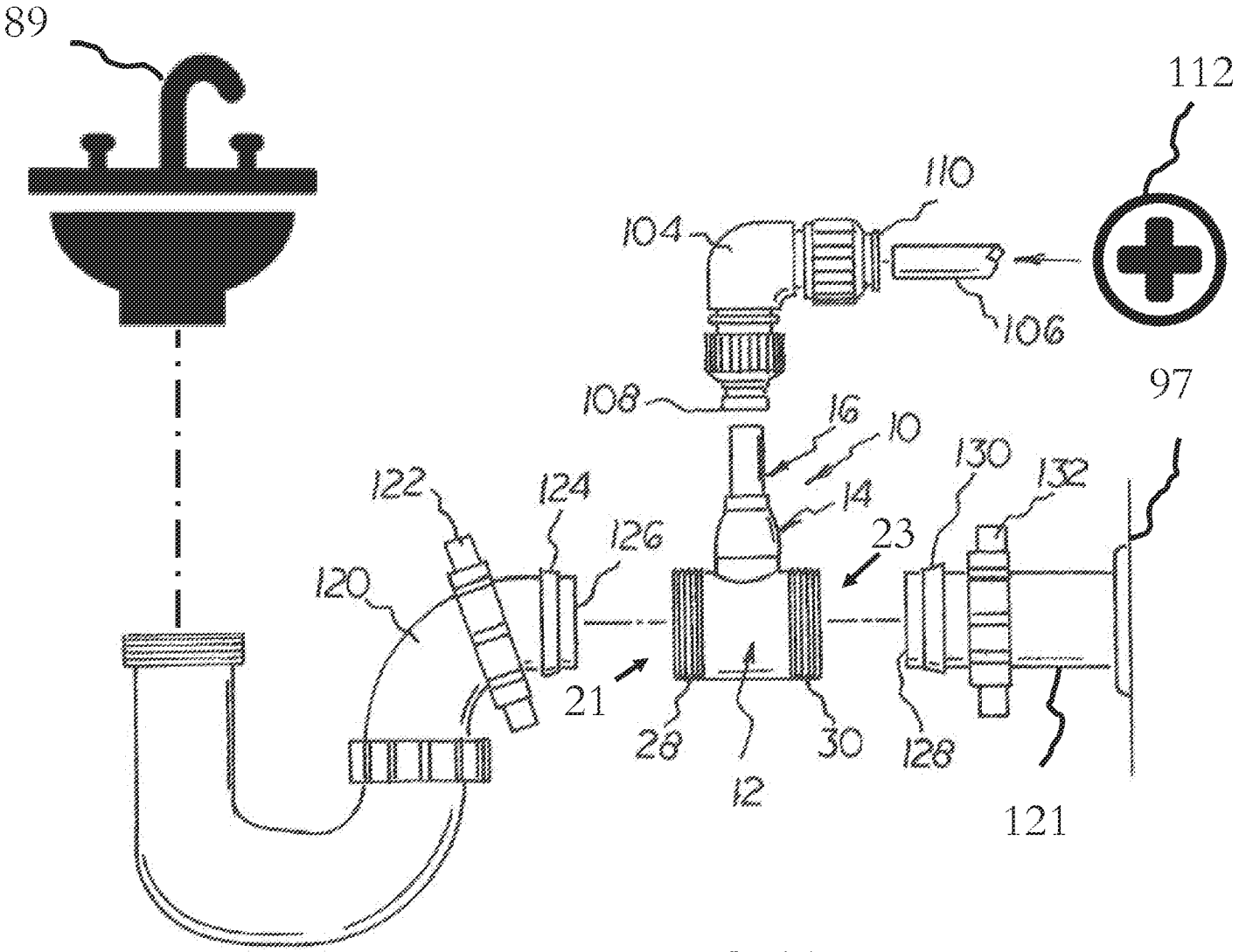
FIG. 11 is an exploded assembly view of an embodiment of the connector apparatus of the present invention in association with an embodiment of a conventional trap and drainpipe set up.

Turning to FIG. 11, an alternative assembly is shown, including reversing elbow 120 that replaces drainpipe 90. Reversing elbow 120 includes end edge 126, second locking ring 122, the corresponding retainer ring 124, and shortened straight section 121 of drainpipe 120 adjacent to the depicted wall. When reversing elbow 120 is employed as depicted in FIG. 11, only one cut (i.e., a single cut) needs be made to drainpipe straight section 121. Once the cut is made, end edge 128 is inserted into section pipe opening 21 of main pipe member 12. Next, lock ring 132 and retainer ring 130 are disposed on drainpipe 90. Next, end edge 126 of reversing elbow 120 is disposed within first pipe opening 23 of in-line pipe connector assembly 10. Locking rings 122, 123 are then tightened onto threaded end sections 28, 30 of main pipe member 12. In such embodiments, such installation of pipe connector 10 is suitable where washbasin 89 is located near an adjoining wall, where space underneath washbasin 89 is limited or a minimum amount of cutting (i.e., removing) of a portion of drainpipe 90 is desired.

The components of the present invention can be made from inexpensive, durable molded plastic materials. Fabrication of the pipe connector apparatus 10 of the present invention is relatively easy and therefore inexpensive. In an embodiment, valve assembly 72 can be joined to valve housing 14. By inserting spindle 76 into central opening 54 of hub 52, valve housing 14 can be joined as by suitable gluing to support boss 32 of main pipe member 12. Finally, riser 16 can be joined in place at the bottom of recess 46 (again as by suitable gluing).

From the foregoing, it will be apparent that the pipe connector apparatus 10 of the present invention is suitable for advantageous use in a wide variety of applications. One such application, mentioned by way of example, and merely as illustrative and not to be construed as limiting, is to provide a convenient, effective, and safe means for removing the exhaled waste gas of a patient breathing a mixture of nitrous oxide and oxygen during a medical procedure being performed in a treatment room via an analgesia system, such as that commercially distributed by Sedation Systems LLC, St. Petersburg, Fla., under the Nitrouseal® trademark. An embodiment of the Nitrouseal® analgesia system is disclosed in U.S. Pat. No. 8,826,905 B2, entitled "Respiratory Face Mask and Breathing Circuit Assembly," which is hereby incorporated by reference in its entirety. By further way of example, in the aforementioned Nitrouseal® analgesia system, a Miniscav® portable waste gas evacuation pump manufactured by RA Medical Svcs., Ltd., Steeton, England may be used as the "scavenger" or "vacuum" to remove expired waste gas from the treatment area where the equipment is being used.

Figure 12:
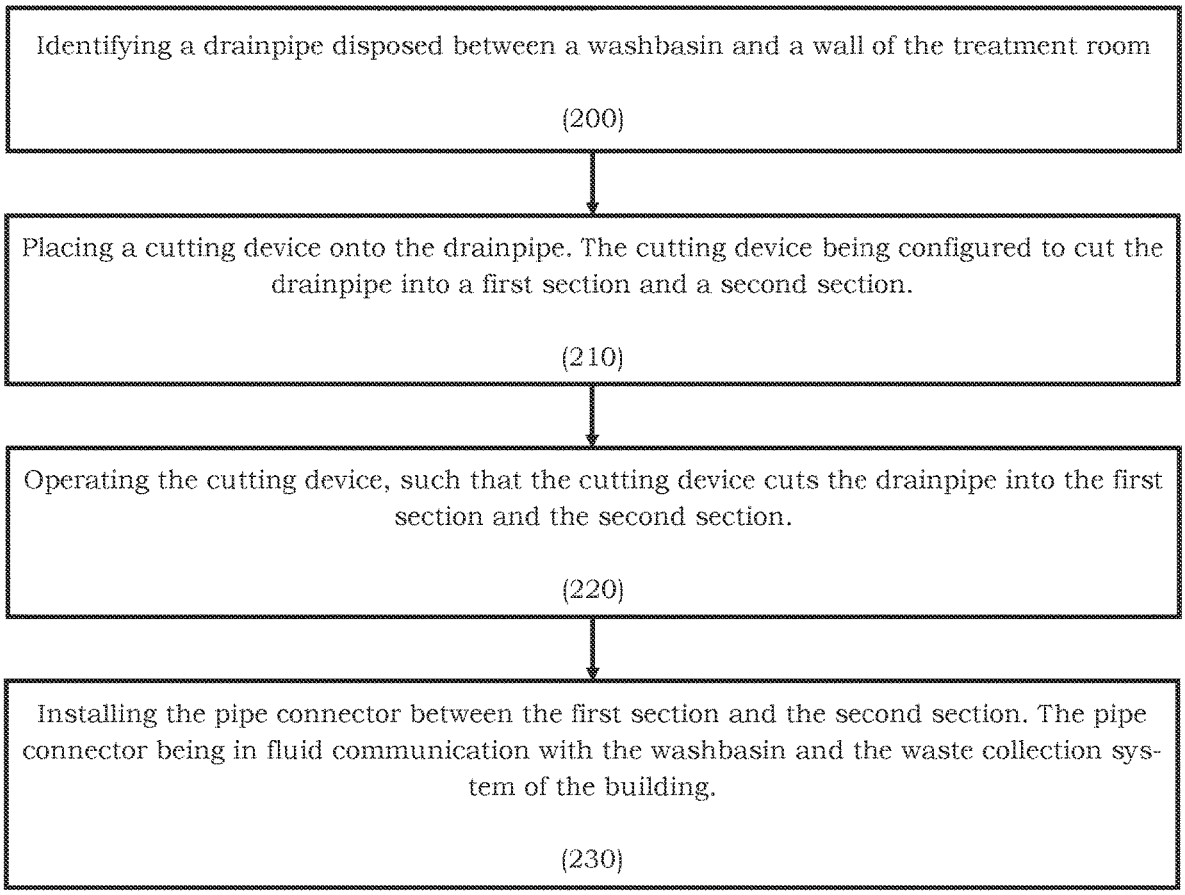
FIG. 12 is a flow chart depicting the steps of a method of evacuating a medical waste gas from a treatment room within a building.
Figure 12:
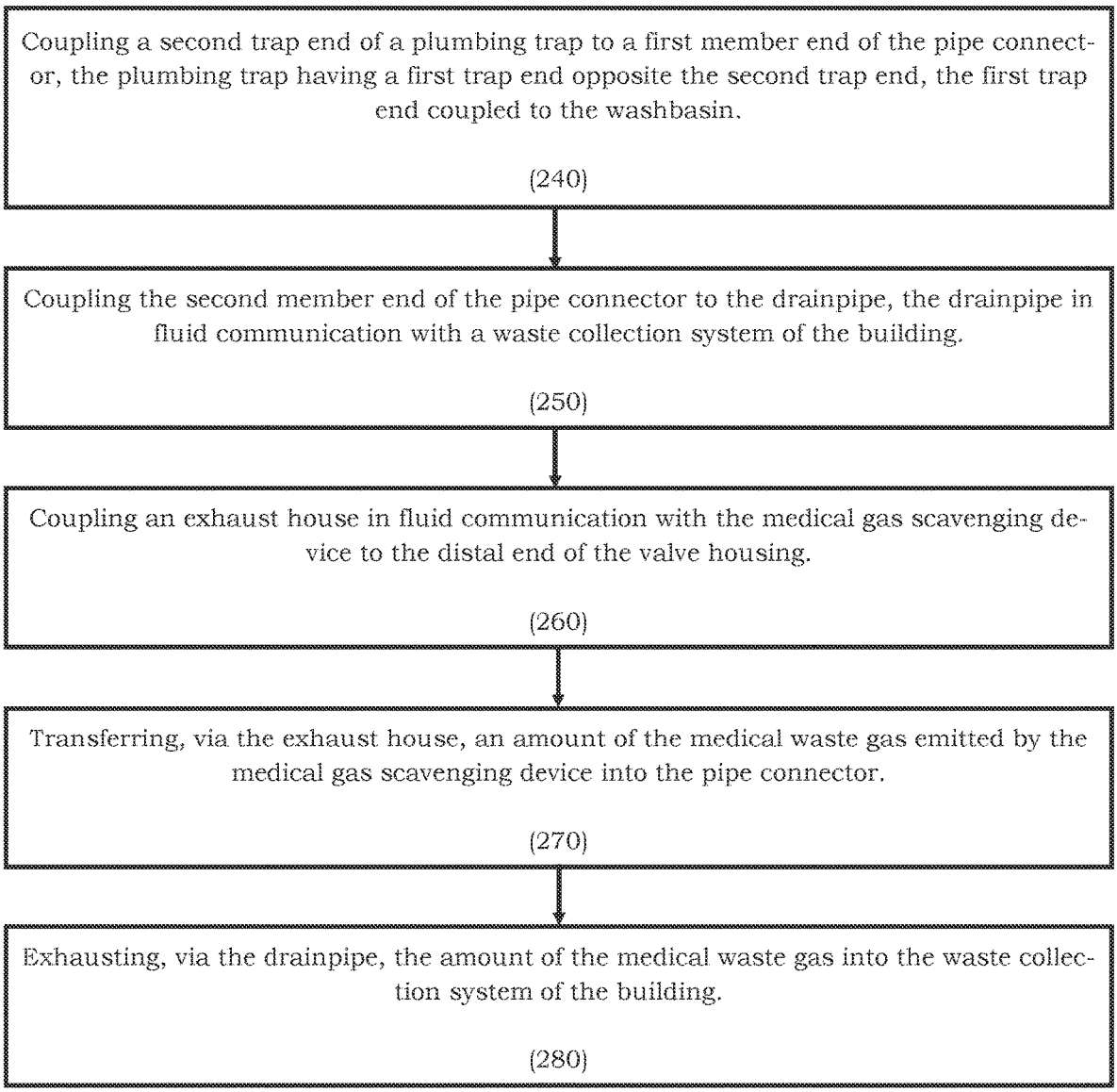

Referring now to FIG. 12, in conjunction with FIGS. 1-11, an exemplary process flow diagram is provided, depicting a method for the removal of a medical waste gas from within a treatment room. The steps delineated in the exemplary process flow diagram of FIG. 12 are merely exemplary of a preferred order for the removal of a medical waste gas from a treatment room. The steps may be carried out in another order, with or without additional steps including therein. Additionally, the steps may be carried out with an alternative embodiment of pipe connection apparatus 10, as contemplated in the above description.

The method for the removal (or evacuation) of a medical gas from a treatment room of a building begins at step 200, during which a drainpipe disposed between a washbasin and a wall of the treatment room is identified. At step 210, a cutting device is placed onto the drainpipe. The cutting device being configured to cut the drainpipe into a first section and a second section. At step 220, the cutting device is operated, such that the drainpipe is cut into the first section and the second section. Next, the pipe connector apparatus is installed between the first section and the second section at step 230. Specifically, at step 240, a second trap end of a plumbing trap is coupled to a first member end of the pipe connector. The plumbing trap includes a first trap end opposite a second trap end, wherein the first trap end is coupled to a washbasin. The pipe connection apparatus includes the components discussed above. The method then proceeds to step 250, in which the second member end of the pipe connector is coupled to a drainpipe. The drainpipe being in fluid communication with a waste collection system of the building. In step 260, an exhaust hose in fluid communication is coupled with a medical gas scavenging device to the distal end of the valve housing. In step 270, an amount of the medical waste gas emitted by the medical gas scavenging device is transferred, via the exhaust hose, into the pipe connector. Next, at step 280, the amount of the medical waste gas is exhausted, via the drainpipe, into the waste collection system of the building.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A pipe-connector assembly system for exhausting a waste gas from an interior environment of a building, the system comprising:
- a plumbing trap having a first trap end and a second trap end, wherein the first trap end is connected with a washbasin disposed within the interior environment;
- a pipe connector assembly including:
  - a main pipe member extending between a first member end and a second member end, the first member end connected with the second trap end;
  - a valve housing including a proximal end, a distal end, and a valve residing within the valve housing and disposed between the proximal end and the distal end of the valve housing, wherein the proximal end is connected with the main pipe member and the distal end is connected with a gas scavenger device; and
- a drainpipe having a first end connected with the second member end of the pipe connector assembly and a second end connected with a waste collection system of the building,
- wherein the waste gas flows from the gas scavenger device through the pipe connector assembly and into the waste collection system of the building, such that the waste gas is safely evacuated from the interior environment.

2. The system of claim 1, further comprising:
- a quick-release valve having an inlet, an output, and a passage extending between the inlet and the output;
- the inlet configured to be removably coupled to an exhaust hose of the gas scavenger device; and
- the output connected with the distal end of the valve housing,
- wherein the waste gas travels from the gas scavenger device through the quick-release valve to the pipe connector assembly and exhausted into the waste-collection system of the building.

3. The system of claim 1, further comprising:
- a riser disposed between the distal end of the valve housing and the gas scavenger device, the riser including:
  - a body defining a bore extending between a first riser end coupled to the distal end of the valve housing and a second riser end coupled to an exhaust hose of the gas scavenger device, wherein the riser is fluidically coupled with the main pipe member and the gas scavenger device.

4. The system of claim 1, further comprising:

a first attachment mechanism disposed at the first member end and configured to threadedly engage with a second attachment mechanism disposed at the second trap end of the plumbing trap; and a third attachment mechanism disposed at the second member end and configured to threadedly engage with the first end of the drainpipe, wherein the pipe connector assembly is secured between the plumbing trap and the drainpipe.

5. The system of claim 1, wherein the valve is a one-way valve, such that that the backflow of the waste gas from the waste collection system back into the internal environment is prevented.

6. The system of claim 1, wherein the valve includes:

a flexible portion configured to be translatable between a closed configuration and an open configuration, wherein the flexible portion is biased toward the closed position, such that that the backflow of the waste gas from the waste collection system back into the internal environment is prevented, wherein when in the open configuration, the flexible portion permits the waste gas to flow through the valve housing from the internal environment to the waste collection system of the building.

7. The system of claim 1, wherein the waste gas is a medical waste gas generated by an analgesic system fluidically coupled with the gas scavenger system.

8. The system of claim 1, wherein the waste gas comprises a mixture of nitrous oxide and oxygen.

9. A pipe-connector assembly system for exhausting a medical waste gas from a treatment room within a building, the system comprising:

a plumping trap having a first trap end and a second trap end, wherein the first trap end is connected with a washbasin disposed within the treatment room;

a pipe connector assembly including:

a main pipe member extending between a first member end and a second member end, the first member end connected with the second trap end;

a valve housing including a proximal end, a distal end, and a one-way valve residing within the valve housing and disposed between the proximal end and the distal end of the valve housing, wherein the proximal end is connected with the main pipe member and the distal end is connected with a medical gas scavenger device;

the one-way valve including a flexible portion configured to be translatable between an open configuration to permit the flow of the medical waste gas through the valve housing and a closed configuration configured to prevent the flow of the medical waste gas through the valve housing, wherein the flexible portion is biased toward the closed configuration; and a drainpipe having a first end connected with the second member end of the pipe connector assembly and a second end connected with a waste collection system of the building, wherein the medical waste gas flows from the medical gas scavenger device through the pipe connector assembly and into the waste collection system of the building, such that the medical waste gas is safely evacuated from the treatment room.

10. The system of claim 9, further comprising:

a quick-release valve having an inlet, an output, and a passage extending between the inlet and the output;

the inlet configured to be removably coupled to an exhaust hose of the medical gas scavenger device; and the output connected with the distal end of the valve housing, wherein the medical waste gas travels from the medical gas scavenger device through the quick-release valve to the pipe connector assembly and exhausted into the waste-collection system of the building.

11. The system of claim 9, further comprising:

a riser disposed between the distal end of the valve housing and the medical gas scavenger device, the riser including:

a body defining a bore extending between a first riser end coupled to the distal end of the valve housing and a second riser end coupled to an exhaust hose of the medical gas scavenger device, wherein the riser is fluidically coupled with the main pipe member and the medical gas scavenger device.

12. The system of claim 9, wherein the pipe connector assembly further comprises:

a first attachment mechanism disposed at the first member end and configured to threadedly engage with a second attachment mechanism disposed at the second trap end of the plumbing trap; and a third attachment mechanism disposed at the second member end and configured to threadedly engage with the first end of the drainpipe, wherein the pipe connector assembly is secured between the plumbing trap and the drainpipe.

13. The system of claim 9, wherein the medical waste gas comprises a mixture of nitrous oxide and oxygen.

14. The system of claim 9, wherein the flexible portion of the one-way valve has a convex shape when in the closed configuration, thereby preventing the flow of the medical waste gas within the valve assembly.

15. The system of claim 9, wherein the flexible portion has a convex shape when in the open configuration.

16. The system of claim 9, wherein the valve housing further comprises:

an interior wall extending between the proximal end and the distal end, the interior wall defining a channel therein;

a support floor member disposed within the channel, the support floor member including a central hub defining a central valve-step support aperture and a rib extending radially between the central hub and the interior wall of the channel.

17. The system of claim 16, wherein the one-way valve further includes:

a support spindle having a first end and a second end, the first end slidably disposed at least partially within the central valve-step support aperture;

the flexible portion disposed at the second end of the support spindle; and a nub disposed on a portion of the support spindle between the flexible portion and the first end of the support spindle, wherein the nub prevents the support spindle from being removed from within the valve-step support aperture, thereby securing the support spindle within the channel.

18. A method of exhausting a medical waste gas scavenged by a medical gas scavenging device from a treatment room in a building, the method comprising:

coupling a second trap end of a plumbing trap to a first member end of a pipe connector, the plumbing trap having a first trap end opposite the second trap end, the first trap end coupled to a washbasin, the pipe connector including:

a second member end opposite the first member end and a main pipe member extending therebetween; and a valve housing including a proximal end opposite a distal end, and a valve residing within the valve housing and disposed between the proximal end and the distal end, the valve housing extending orthogonally away from the main pipe member between the first member end and the second member end;

coupling the second member end of the pipe connector to a drainpipe, the drainpipe fluidically coupled with a waste collection system of the building;

coupling an exhaust hose fluidically coupled with the medical gas scavenging device to the distal end of the valve housing;

transferring, via the exhaust hose, an amount of the medical waste gas emitted by the medical gas scavenging device into the pipe connector; and exhausting, via the drainpipe, the amount of the medical waste gas into the waste collection system of the building.

19. The method of exhausting the medical waste gas of claim 18, further comprising the steps of:

providing a quick release valve having an inlet, an output, and a passage extending between the inlet and the output;

coupling the inlet to the exhaust hose of the medical gas scavenger device;

coupling the outlet to the distal end of the valve housing; and transferring, via the quick-release valve, the medical waste gas flows from the medical gas scavenging device to the pipe connector.

20. The method of exhausting the medical waste gas of claim 18, further comprising the steps of:

identifying the drainpipe disposed between the washbasin and a wall of the treatment room;

placing a cutting device onto the drainpipe, the cutting device configured to cut the drainpipe into a first section and a second section;

operating the cutting device, such that the cutting device cuts the drainpipe into the first section and the second section; and installing the pipe connector between the first section and the second section, such that the first member end of the pipe connector is connected with the first section, and such that the second member end of the pipe connector is connected with the second section, wherein the pipe connector is fluidically coupled with the washbasin and the waste collection system of the building.

* * * * *